US005226369A

United States Patent [19]

Weber

[11] Patent Number: 5,226,369

[45] Date of Patent: Jul. 13, 1993

[54] SIDEFRAME FOR A RAILROAD CAR TRUCK

[75] Inventor: Hans B. Weber, Rotonda West, Fla.

[73] Assignee: National Castings Inc., Lisle, Ill.

[21] Appl. No.: 898,704

[22] Filed: Jun. 15, 1992

[51] Int. Cl.[5] ..... B61F 5/00

[52] U.S. Cl. ..... 105/206.1

[58] Field of Search ..... 105/206.1, 218.1, 219, 105/224.05, 157.1, 167, 182.1, 206.2, 220, 224.06

[56] References Cited

U.S. PATENT DOCUMENTS

| | | | |
|---|---|---|---|
| 2,065,453 | 12/1936 | Hammerstrom | 105/206.2 |
| 3,338,183 | 8/1967 | Boissier | 105/206.1 |
| 3,517,620 | 6/1970 | Weber | 105/193 |
| 4,133,268 | 1/1979 | Guillaumin | 105/206.2 |
| 4,236,457 | 12/1980 | Cope | 105/218.1 |

FOREIGN PATENT DOCUMENTS

| | | | |
|---|---|---|---|
| 0053315 | 4/1977 | Japan | 105/206.2 |
| 0393144 | 8/1973 | U.S.S.R. | 105/206.2 |

*Primary Examiner*—Mark T. Le

[57] ABSTRACT

A railroad car sideframe of a truck is provided with a pair of identical twin ribs which are designed to reinforce and strengthen each of the pedestal frames against stress failures caused by the large railroad cars being built today and the heavier loads which they are capable of hauling. The use of these twin ribs simplifies the machining operation used in the fabrication of the pedestal frames.

7 Claims, 1 Drawing Sheet

SIDEFRAME FOR A RAILROAD CAR TRUCK

BACKGROUND OF THE INVENTION

The invention relates to railroad cars, especially the trucks or bogies which are located at opposing ends of a railroad car to support the car on the rails of a trackway. More particularly, the invention relates to a passive steering radial truck which is manufactured and sold by National Castings Incorporated of Lisle, Ill. under the trademark AXLE MOTION II. A detailed description of this quality truck with excellent performance characteristics is found in U.S. Pat. No. 3,517,620. The AXLE MOTION II truck is fabricated from many different steel parts and essentially comprises a pair of sideframes which are held in parallel relation by a bolster which is rigidly secured transversely between the two sideframes. Each of the sideframes has a pair of pedestal frames in side-by-side, aligned, spaced relation. Each of the pedestal frames essentially comprises an inverted, generally U-shaped rigid frame which supports an axle box in which one end of an axle with an attached pair of wheels is mounted for rotation.

The AXLE MOTION II truck was designed at a time when railroad cars were smaller than presently built cars which are much larger and capable of carrying heavier loads. The invention is directed to substantially increasing the strength of the pedestal frames of this particular truck without adversely effecting the excellent performance characteristics of the truck, or radically increasing the weight of the truck.

Briefly stated, the invention is in the addition of special reinforcement ribs to an existing pedestal frame. It has been found that such addition not only increase the strength of the pedestal frames, but facilitate the fabrication of the sideframe which is very important, since most of the trucks built today are fabricated from a number of steel components and not integrally cast, as in years gone by, because such castings are enormous and difficult to cast, and expensive to produce.

DESCRIPTION OF THE DRAWING

The following description of the invention will be better understood by having reference to the accompanying drawing, wherein.

DETAILED DESCRIPTION OF THE DRAWING

Figure 1:
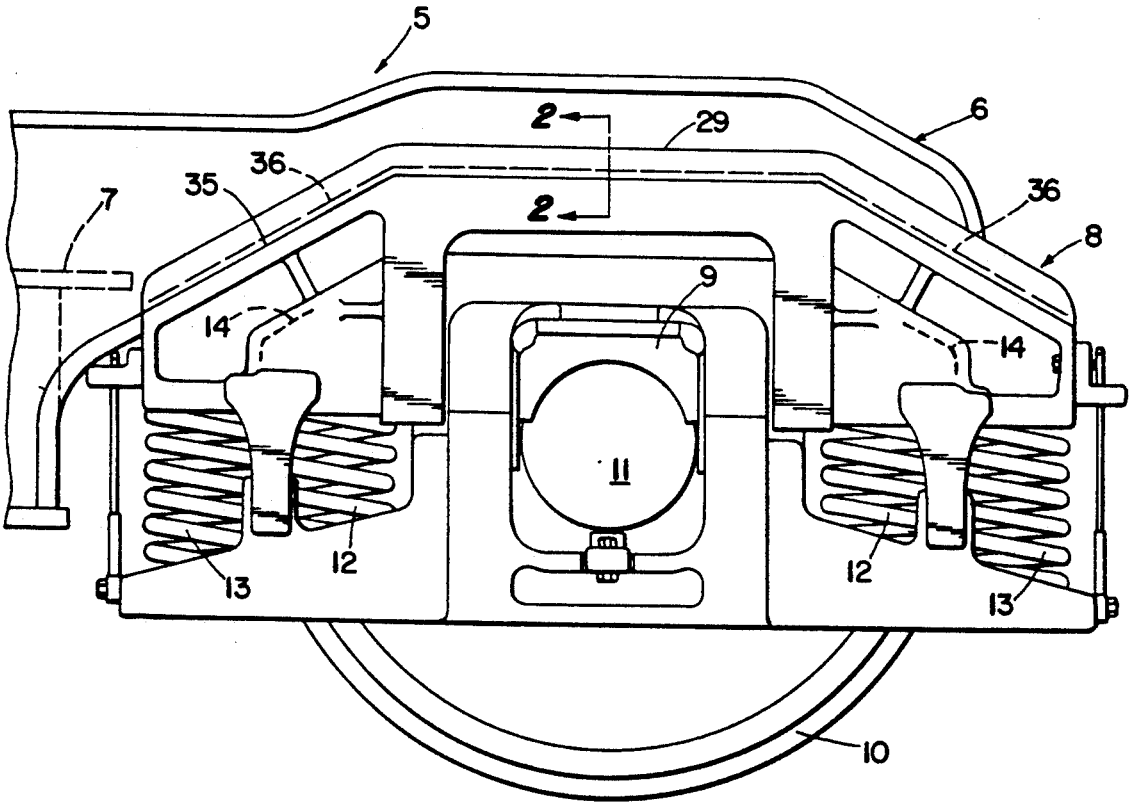
FIG. 1 is a side view of one-half of a sideframe which is made in accordance with the invention.
Figure 3:
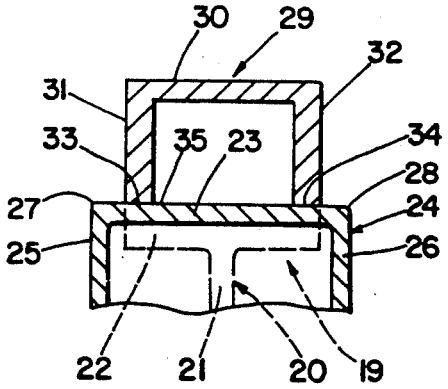
Fig. 3 (PRIOR ART)
FIG. 3 is a similar cross-section, but of a prior art pedestal frame without the improved reinforcement ribs of the invention.

With general reference to the drawing for like parts, and specific reference to FIGS. 1 and 3, there is shown portions of a railroad car truck or bogie 5 which essentially comprises a pair of similar sideframes 6 which are held in parallel relation by a rigid bolster 7 which extends transversely between the sideframes 6 and is firmly secured to the sideframes 6. Each of the sideframes 6 includes a pair of similar, but oppositely disposed pedestal frames 8 which are on opposite sides of the bolster 7 in aligned relation. Each of the pedestal frames 8 is generally U-shaped, but inverted. Each pedestal frame 8 supports a journal saddle or axle box 9 in which a pair of railroad car wheels 10 and attached axle 11 are mounted for rotation. Each pedestal frame 8 also supports two sets of coil springs 12,13, and friction wedges 14 which coact to dampen undesirable motion of the sideframes 6 caused, for example, by the waviness or misalignment of the rails of the trackway.

Each of the existing pedestal frames 8 has an upper frame portion 19 which is vertically spaced above the wheel axle 11 when the truck 5 is mounted on a level trackway. This upper frame portion 19, as seen in FIG. 3, includes an I-beam shaped inner member 20 having a web 21 and an outer flange 22 which are integrally cast with the planar web 23 of a rigid, intermediate member 24 which has a pair of flanges 25 and 26 which extend in parallel relation from the opposing marginal edges 27 and 28, respectively, of the planar web 23 in the direction of the web 21 of the inner member 20. An outer member 29, similar in shape to the intermediate member 24, but having a narrower web 30 and longer connecting flanges 31 and 32, is secured atop the web 23 of the intermediate member 24, i.e. the distal ends 33 and 34 of the flanges 31 and 32 are welded to the outer planar surface 35 of the web 23 of the intermediate member 24. It can be appreciated by those skilled in the design and manufacture of railroad car trucks or bogies, that the relatively large outer planar surface 35 of the intermediate member 24 must be precisely machined, if the outer member 29 is to be properly welded to the intermediate member 24. The invention, besides strengthening each of the pedestal frames 8, has the advantage of simplifying the aforementioned welding process, as will become apparent from the following description.

Figure 2:
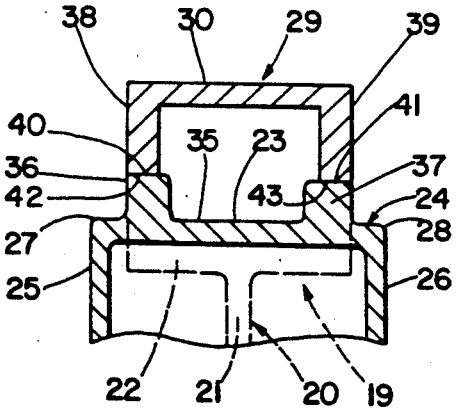
FIG. 2 is a cross-section of the reinforcement ribs of a typical pedestal frame, as viewed from the line 2—2 of FIG. 1.

The invention, as best seen in FIG. 2, is in the provision of a pair of identical, solid twin ribs 36 and 37 which are integrally formed with the intermediate member 24 and project outwardly from the planar surface 35 in parallel directions away from the outer flange 22 of the inner member 20. The twin ribs 36 and 37 are continuous as they span the pedestal frame 8 which supports the axle box 10 and the two sets of coil springs 12,13, and friction wedges 14. The twin ribs 36 and 37 provide the reinforcement necessary to properly strengthen the pedestal frame 8, and no extra material is needed to fill in the space between the ribs 36 and 37 to make one, extra wide rib.

The outer member 29 of FIG. 2 has the same size planar web 30, but shorter flanges 38 and 39 than the corresponding longer flanges 31 and 32 of the existing pedestal frame of FIG. 3, so that the overall height of the web 30 above the outer surface 35 of the intermediate member 29, in both structures of FIGS. 2 and 3, is the same. However, welding the free distal ends 40 and 41 of the shorter flanges 38 and 39 is simplified and more economical, because the outer surfaces 42 and 43 of the twin ribs 36 and 37 are much narrower than the large planar surface 35 of the intermediate 24 and, therefore, require less machining.

Thus, there has been described a unique way of strengthening the pedestal frames of a railroad car sideframe without radically increasing the weight of the sideframe or altering its basic design. The machining operation used on the twin reinforcement ribs of the invention is much simpler, more precise, and certainly more economical than that used to fabricate an existing sideframe without such ribs. The ribs also keep the welds away from the main structure of the pedestal casting, thereby reducing weld stresses.

What is claimed is:

1. A sideframe for a railroad car, comprising:

a) at least one pedestal frame having an inverted, generally U-shape and designed to support one end of a wheel and axle assembly, said at least one pedestal frame including, in cross-section:

b) a first member having, I) a planar web with opposing parallel marginal edges, II) a pair of flanges integrally formed with the web and extending from the marginal edges of the member in parallel relation away from the web, and III) at least one solid rib integrally formed with the web between opposing marginal edges of the web, the at least one rib extending from the web in an opposite direction from the flanges and being parallel to the flanges, the at least one rib reinforcing the pedestal frame and having a free distal end with a smooth outer surface; and c) a second member which is separate from the first member and has, IV) a planar web which is parallel to the planar web of the first member, and V) at least one flange integrally formed with the planar web of the second member and extending therefrom into abutting relation with the rib, the at least one flange of the second member having a free distal end which is secured to the smooth outer surface of the rib.

2. The sideframe of claim 1, wherein the first member includes a plurality of solid, parallel ribs which are continuous and coextensive with the length of the first member, and the second member includes a plurality of parallel flanges with free distal ends which are secured to the smooth outer surfaces of the plurality of ribs.

3. The sideframe of claim 2, wherein the first member is an integral part of the pedestal frame.

4. The sideframe of claim 3, wherein the plurality of ribs are a pair of identical twin ribs which are sufficiently sized to reinforce the members, the ribs having distal ends with smoothly machined outer surfaces, and the distal ends of the flanges of the second member are corrected to the machined surfaces of the ribs.

5. A railroad car truck, comprising:

a) at least one side frame including at least one pedestal frame supporting an axle box which is designed to support a wheel and axle assembly, said at least one pedestal frame comprising:

b) a first member, in cross-section, having; I) a planar web with parallel marginal edges, II) a pair of flanges integrally formed with the web and extending from the web in parallel directions towards the axle box, and III) a pair of solid, identical twin ribs which are integrally formed with the web and extend from the web in parallel directions away from the axle box, the ribs being sufficiently sized to reinforce and strengthen the adjacent pedestal frame to which the ribs are secured, the ribs having distal ends with machined outer surfaces; and c) a second member, in cross-section with the first member, having a planar web with outstanding flanges which extend in parallel relation towards the machined surfaces of the twin ribs, the outstanding flanges of the second member being connected to the machined surfaces of the twin ribs.

6. The railroad car truck of claim 5, wherein the twin ribs are continuous and coextensive with the length of the web of the first member.

7. The railroad car truck of claim 6, wherein the first member is integrally formed with an adjacent pedestal frame.

* * * * *